US006955448B1

(12) United States Patent
Lefferson

(10) Patent No.: US 6,955,448 B1
(45) Date of Patent: Oct. 18, 2005

(54) UNDER THE BED NIGHT LIGHT

(76) Inventor: Peter Lefferson, 6101 7th Ave. North, St. Petersburg, FL (US) 33710-7015

( * ) Notice: Subject to any disclaimer, the term of this patent is extended or adjusted under 35 U.S.C. 154(b) by 0 days.

(21) Appl. No.: 10/904,098

(22) Filed: Oct. 22, 2004

Related U.S. Application Data

(60) Provisional application No. 60/481,580, filed on Oct. 30, 2003, provisional application No. 60/481,691, filed on Nov. 21, 2003.

(51) Int. Cl.[7] ..... F21V 33/00
(52) U.S. Cl. ..... 362/240; 362/127; 362/130
(58) Field of Search ..... 362/190, 191, 362/240, 249, 127, 130, 253

(56) References Cited

U.S. PATENT DOCUMENTS 3,596,077 A * 7/1971 Miazga ..... 362/96
4,220,984 A * 9/1980 Truher et al. ..... 362/130
4,298,868 A * 11/1981 Spurgeon ..... 345/31
4,697,950 A * 10/1987 Copeland ..... 404/9
4,992,914 A * 2/1991 Heiss et al. ..... 362/153.1
5,006,971 A * 4/1991 Jenkins ..... 362/252
5,422,801 A * 6/1995 Sangalli, Jr. ..... 362/252
6,354,711 B1 * 3/2002 McCoy ..... 362/101
6,450,661 B1 * 9/2002 Okumura ..... 362/240
6,543,911 B1 * 4/2003 Rizkin et al. ..... 362/307
6,644,834 B2 * 11/2003 Christen ..... 362/311
6,663,260 B1 * 12/2003 Tieszen ..... 362/249

* cited by examiner

*Primary Examiner*—Thomas M. Sember
*Assistant Examiner*—Jacob Y. Choi
(74) *Attorney, Agent, or Firm*—Ronald E. Smith; Smith & Hopen, P.A.

(57) ABSTRACT

A low profile night light adapted to be positioned in a substantially level plane atop a floor has cylindrical sidewalls and apertures formed in the sidewalls at regularly spaced intervals. At least one light source such as an incandescent or fluorescent light or a light-emitting diode is positioned in registration with at least one of the apertures so that the at least one light source illuminates a fan-shaped area of a floor. A circular area is illuminated if a light source is placed into registration with each aperture. The night light may be positioned under a bed or other item of furniture and may be battery operated or connected to a wall outlet by an elongate power cord. Unlike a conventional night light that illuminates only an area near an electrical wall outlet, the novel night light can be positioned anywhere on a floor where a tripping hazard might exist.

21 Claims, 7 Drawing Sheets

UNDER THE BED NIGHT LIGHT

CROSS-REFERENCE TO RELATED DISCLOSURES

This disclosure claims priority to a first pending U.S. provisional patent application by the same inventor entitled "Under The Bed Night Light" bearing Ser. No. 60/481,580, filed Oct. 30, 2003, and of a second pending U.S. provisional patent application by the same inventor entitled: "Wide Angle Under The Bed Night Light" bearing Ser. No. 60/481,691, filed Nov. 21, 2003.

BACKGROUND OF THE INVENTION

1. Field of the Invention

This invention relates to night lights. More particularly, it relates to a night light that is positioned on a floor, preferably under a bed, in remotely spaced relation to an electrical wall outlet.

2. Description of the Prior Art

Conventional night lights are releasably plugged into electrical wall outlets. Accordingly, they provide a dim light in the immediate vicinity of the wall outlet. If a user needs lighting at a different part of the room, that need cannot be fulfilled by a conventional night light.

Thus there is a need for a night light that could be positioned away from an electrical wall outlet. More specifically, there is a need for a night light that can be positioned at any location in a room where illumination is needed.

Conventional night lights use incandescent bulbs and typically have no on/off switch. Thus, they consume about four (4) watts of power twenty four hours a day. They also generate heat that can start fires if they are positioned near a combustible material. Thus, positioning an incandescent light bulb beneath a bed or other article of furniture creates a hazard.

A need therefore exists for a night light that consumes substantially less power and that generates substantially less heat than a conventional night light so that it can be safely positioned beneath an article of furniture such as a bed.

However, in view of the prior art taken as a whole at the time the present invention was made, it was not obvious to those of ordinary skill in this art how the identified needs could be fulfilled.

SUMMARY OF THE INVENTION

The long-standing but heretofore unfulfilled need for a means for an improved night light is now met by a new, useful, and non-obvious invention.

The novel night light includes a housing of predetermined configuration. In a first embodiment, the housing has a top wall, a bottom wall, and a sidewall interconnecting the top and bottom walls. The housing is adapted to lie atop a floor and has a low profile so that it is adapted to be positioned under a preselected article of furniture such as a bed.

At least one light source is associated with the housing and at least one aperture of predetermined configuration is formed in the sidewall of the housing. The at least one aperture is configured to enable the at least one light source to illuminate at least a part of the floor.

Significantly, the novel night light may be positioned at any preselected location on a floor where illumination is desired. It is not restricted to being mounted on an electrical wall outlet.

The at least one light source may be positioned within the housing, radially inward of the at least one aperture, it may be positioned flush with the at least one aperture, or it may be positioned externally of the housing, radially outward of the at least one aperture.

In a preferred embodiment, the sidewall of the housing has a cylindrical configuration and the at least one aperture has a predetermined circumferential extent. The at least one light source is positioned within the housing, radially inward of the at least one aperture so that at least one generally fan-shaped area of the floor is illuminated.

In another embodiment, a plurality of apertures is formed in the sidewall so that plural areas of the floor are illuminated by one or more light sources. Where plural light sources are employed, each light source may be associated with an aperture of the plurality of apertures and each light source is disposed radially inward of its associated aperture, flush with its associated aperture, or radially outward thereof.

In still further embodiments, the sidewall of the housing has a multifaceted configuration and at least one aperture is formed in at least one face of the multifaceted sidewall.

In the preferred embodiments, the housing has a flat top wall and a flat bottom wall adapted to overlie a floor. The top wall, bottom wall, and side wall, or any combination thereof, may be formed of a clear, translucent, or opaque material. In a preferred embodiment, the top, bottom, and side walls are formed of a translucent material.

The light source or light sources are in electrical communication with a source of electrical power. In a first embodiment, an elongate power cord is adapted to provide electrical communication between the light source or sources and a remote electrical wall outlet so that the housing may be positioned in remote relation to the electrical wall outlet. In a second embodiment, the housing is adapted to house a battery that is in electrical communication with the light source or sources so that the housing may be positioned at any preselected location in a room.

An important advantage of the invention is its ability to be placed at any location in a room, not just mounted to an electrical wall outlet like a conventional night light.

A closely related advantage is its ability to be safely positioned under a bed or other item of furniture where illumination of a surrounding area may be required.

Another advantage is the low power consumption and low heat generation that characterizes the novel night light.

Another advantage is the ability of the novel night light to emit light in a circular pattern or in a fan-shaped pattern.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
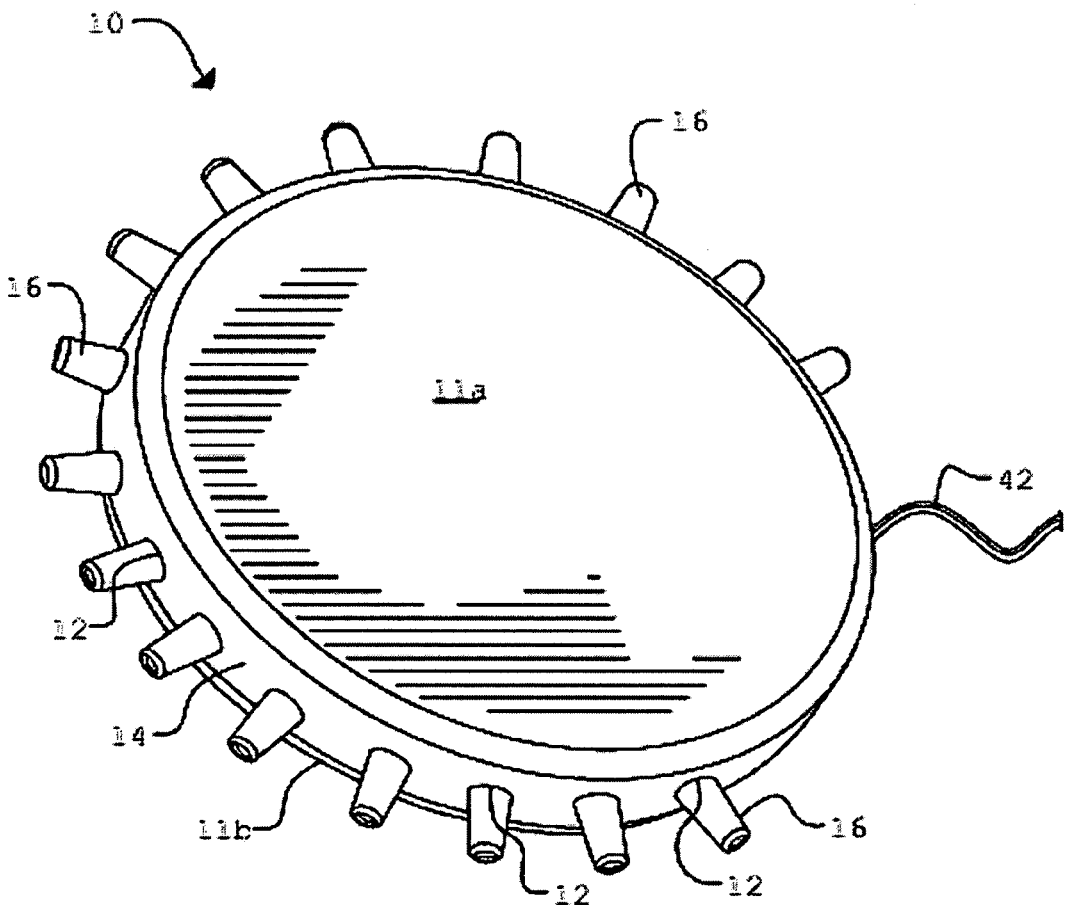
FIG. 1A is a perspective view of a first embodiment of the novel night light.

Referring now to FIG. 1A, it will there be seen that an illustrative embodiment of the invention is denoted as a whole by the reference numeral 10.

In a preferred embodiment, the novel night light includes a low profile cylindrical housing 10 that is preferably about an inch in height and about six inches in diameter. Such dimensions are not critical. More particularly, housing 10 may be of any predetermined geometrical configuration such as cylindrical, multifaceted, or irregular.

Figure 2:
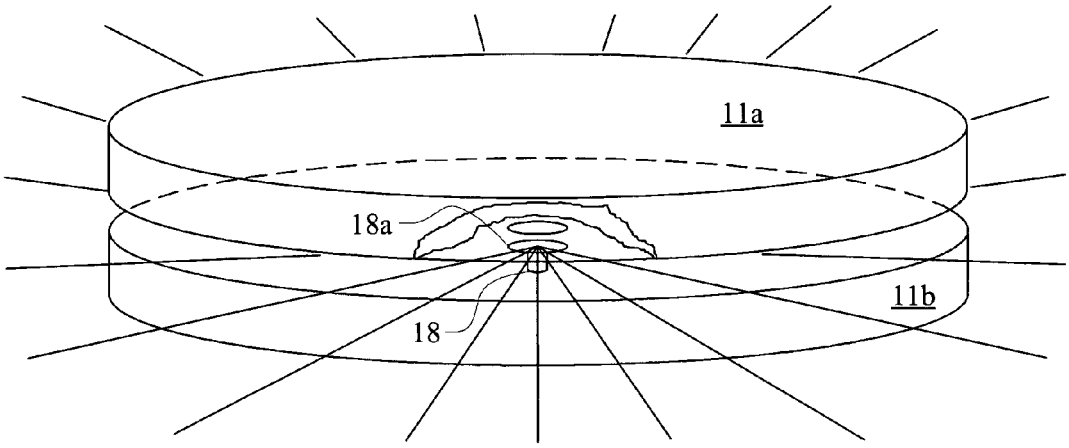
FIG. 2 is a perspective view of a third embodiment thereof.

Top wall 11*a* is preferably flat as is bottom wall 11*b*. Flat bottom wall 11*b* is adapted to rest atop a flat floor or floor covering as depicted in FIG. 2. Either top wall 11*a* or bottom wall 11*b* could be concave instead of flat, and top wall 11*a* could be convex but such shape would undesirably increase its height profile.

In this first embodiment, a plurality of apertures, collectively denoted 12, is formed in cylindrical sidewall 14 about the periphery thereof at approximately twenty degree (20°) intervals in circumferentially spaced, equidistant relation to one another. This angular spacing may be changed because it is not critical. Moreover, the cylindrical shape is not critical because a multi-faceted sidewall where each flat face of the sidewall is disposed at an angle at least slightly greater than one hundred eighty degrees (180°) relative to its contiguous flat face would produce substantially the same effect as will become more clear as this disclosure proceeds.

In the FIG. 1A embodiment, a light-emitting diode (LED) 16 is mounted in each aperture 12. Apertures 12 and LEDs 16 may extend three hundred sixty degrees (360°) about cylindrical sidewall 14 or they may extend thereabout to a lesser extent. For example, in many applications, it may be sufficient to reduce the number of apertures so that apertures 12 and associated LEDs 16 extend about two hundred seventy degrees (270°) about the periphery of sidewall 14. This might be suitable when night light 10 is placed under a bed 13 (FIG. 2) and there is no need to illuminate the floor adjacent a wall against which the headboard of the bed is positioned.

LEDs of any color are within the scope of this invention.

Figure 1B:
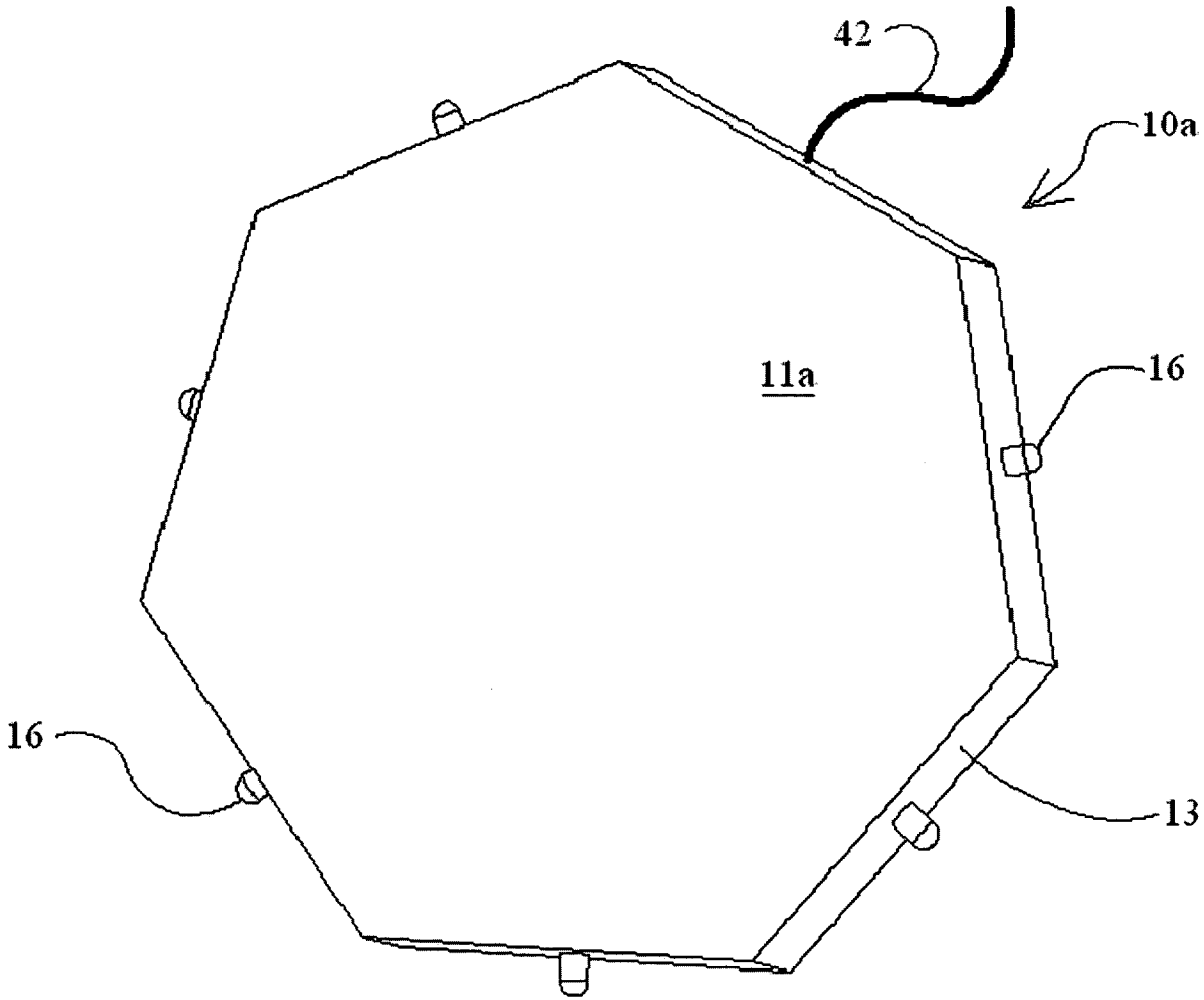
FIG. 1B is a perspective view of a second embodiment thereof.

In the preferred embodiment, each LED is aligned radially with respect to a center of night light housing 10. Each light source 16 may be positioned radially inwardly of its associated aperture 12, flush with its associated aperture, or radially outwardly of its associated aperture as depicted in FIGS. 1A and 1B. In all three positions, a fan-shaped area is illuminated by each light source, although the fan-effect is less when light source 16 is recessed with respect to its associated aperture 12.

If LEDs 16 are positioned radially inwardly of their associated apertures, such apertures may be closed with a clear or colored lens.

Each light source 16 illuminates a fan-shaped area of the floor as aforesaid. Due to the cylindrical structure of sidewall 14, the light emitted collectively by all of the light sources forms a fan shape upon the surface of the floor or floor covering when housing 10 is positioned thereatop. In a preferred embodiment, the angular spacing between the light sources is sufficiently close to ensure that contiguous areas of the floor have no dark, unilluminated areas between them, i.e., that the fan-shaped light emitted by each light source overlaps the fan-shaped light of its contiguous light source by at least some amount.

The illuminated area is essentially circular if apertures 12 are formed about the entire circumference of housing 10 and a light source 16 is positioned in each of the apertures. FIG. 1B depicts a multifaceted embodiment 10*a* having multiple flat faces collectively denoted 13. In this particular embodiment, there is one LED 16 associated with each flat face (with one exception to accommodate power cord 42) but more than one LED per flat face is within the scope of this invention.

This invention is not limited to LEDs as the light source. Fluorescent or incandescent lighting may also be employed but LEDs are preferred due to their low power consumption and their low operating temperature. LEDs or other light sources of any color are within the scope of this invention.

The embodiment of FIG. 2 has no cylindrical or multifaceted sidewalls. Instead top wall 11*a* and bottom wall 11*b* are a little thicker than in their FIG. 1A or 1B configuratons and said top and bottom walls are spaced apart from one another. A single bright LED 18 is mounted at the center of the assembly and the light from said light source is thus emanated in all directions, there being no side walls and thus no need to form apertures in a side wall. Reflector 18*a* enhances the performance of centrally-mounted LED 18.

Figure 3:
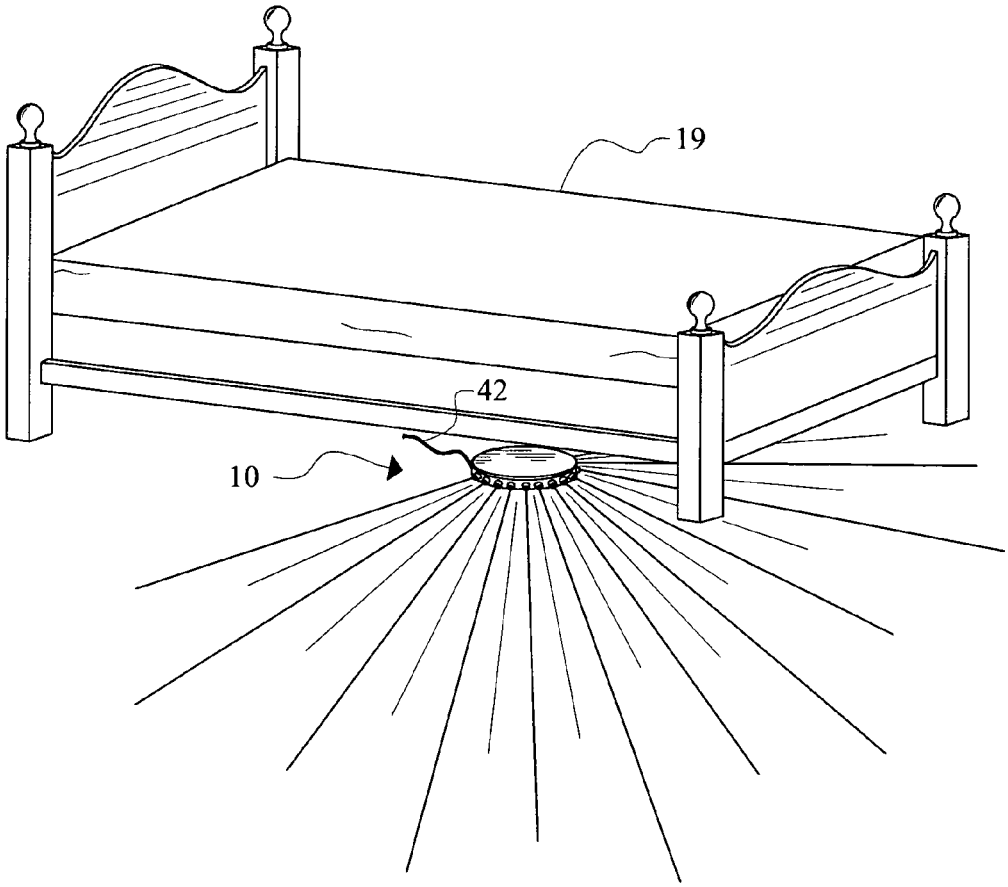
FIG. 3 is a perspective view of a typical application for the novel night light.

FIG. 3 depicts night light housing 10 in its preferred operative position under bed 19. The low profile of housing 10 ensures that it will fit under any bed or other item of furniture such as tables, chairs, and the like. It illuminates the floor in its vicinity, including useful objects such as slippers as well as objects to be avoided such as the legs of tables, chairs, and the like. Due to the relatively large number of LEDs, the amount of illumination provided far exceeds that of a conventional night light.

Figure 4:
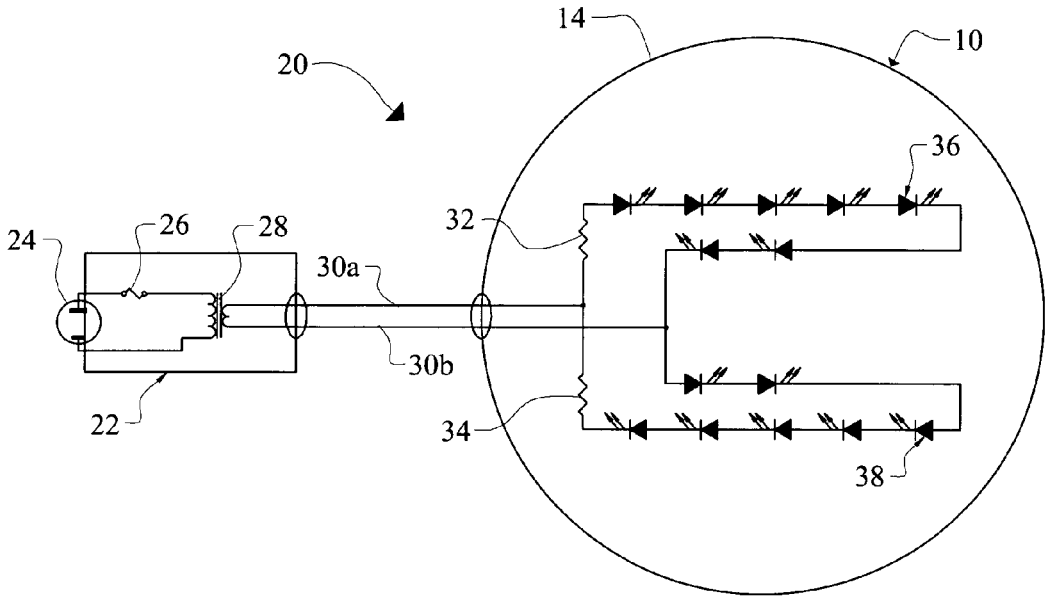
FIG. 4 is an electrical schematic of the novel night light circuitry when powered by a power supply of the wall transformer type.

FIG. 4 provides an electrical schematic, denoted 20 as a whole, that is used when power for the light-emitting means is supplied by a power supply of the wall transformer type. A conventional electrical wall outlet transformer circuit 22 includes wall outlet plug 24, in line fuse 26, a small step down transformer 28, low voltage conductors 30*a*, 30*b*, and control resistors 32, 34.

LEDs 16 are provided in two series circuits that are connected in electrically parallel relation to one another as depicted in FIG. 4. Electrical current flows through LED series circuit 36 during the positive half of the alternating cycle and through LED series circuit 38 during the negative half of the alternating cycle. Accordingly, each diode string 36, 38 emits light during each half cycle of the electrical supply.

Figure 5:
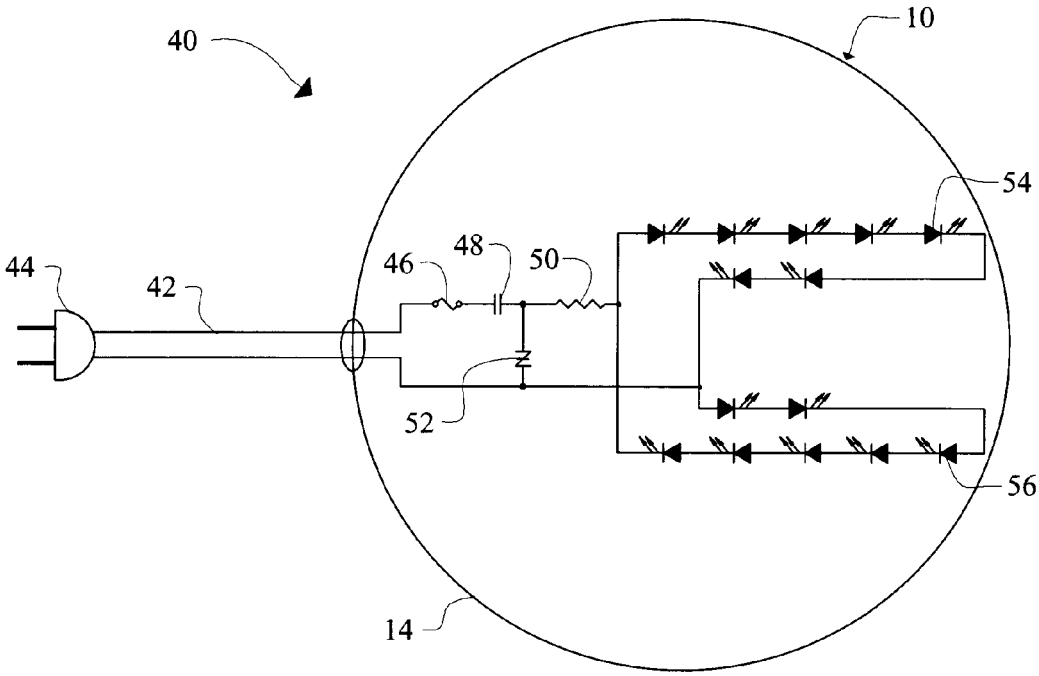
FIG. 5 is an electrical schematic of the novel night light circuitry when powered directly from the electrical mains.

FIG. 5 provides an electrical schematic, denoted 40 as a whole, of the night light when it is powered directly from the electrical mains. Elongate power cord 42 having plug 44 enables night light housing 10 to be positioned substantially anywhere in a room. Fuse 46 protects objects close to housing 10 and the electrical system of the house or other building if a short circuit condition arises inside the night light.

Current through the LEDs is controlled by the impedance of capacitor 48 and therefore no heat is generated. Low resistance resistor 50 limits the initial current surge through the LEDs at the moment when the night light is plugged into a wall outlet. Voltage suppressor 52 protects night light 10 from line voltage surges.

LEDs 16 are provided in two series circuits that are connected in electrically parallel relation to one another as depicted in FIG. 5. Electrical current flows through LED series circuit 54 during the positive half of the alternating cycle and through LED series circuit 56 during the negative half of the alternating cycle. Accordingly, each diode string 54, 56 emits light during each half cycle of the electrical supply.

Figure 6:
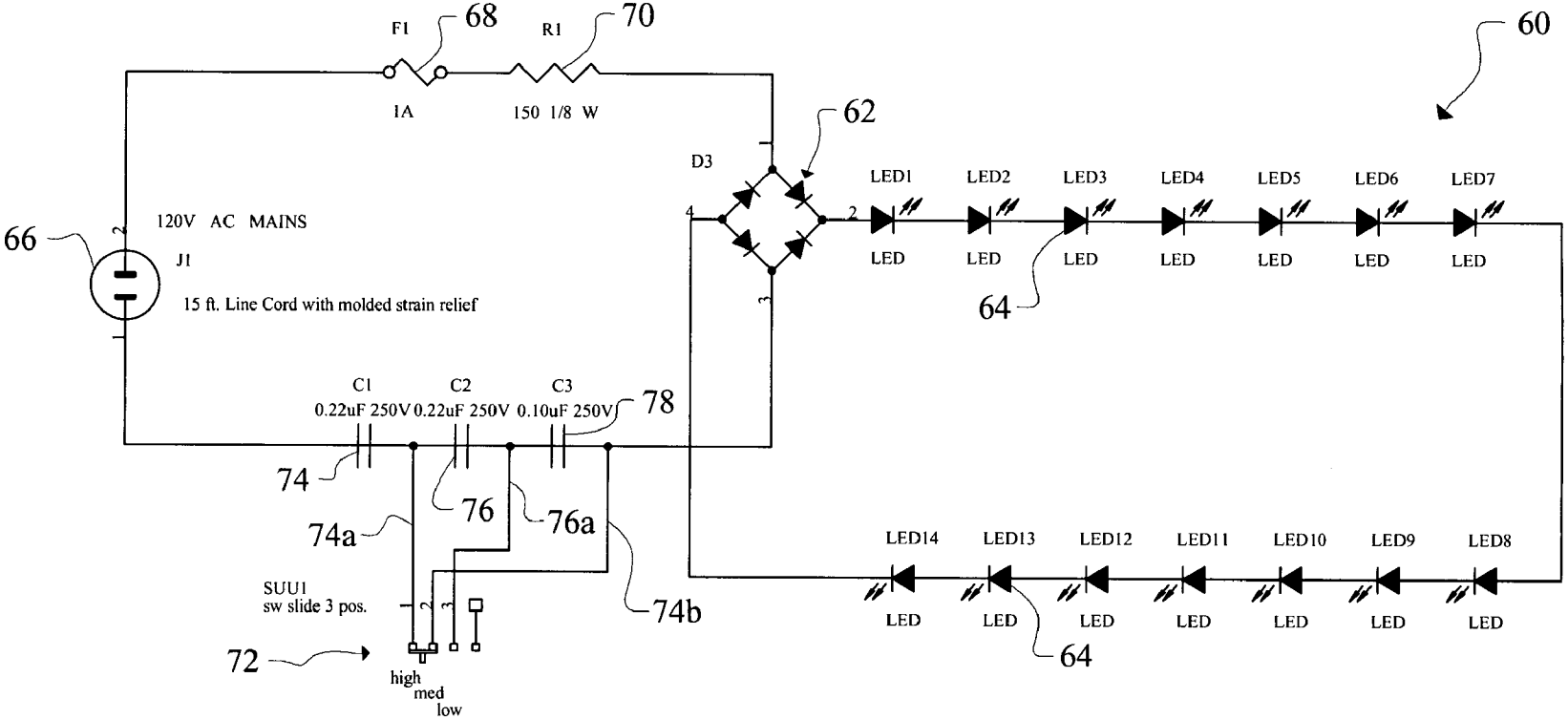
FIG. 6 is an electrical schematic of the novel night light circuitry that includes a diode bridge.

FIG. 6 discloses an embodiment denoted 60 as a whole that includes diode bridge 62. In this embodiment, all LEDs 64 are driven in series so that they flicker at 120 Hz instead of the 60 Hz of the FIGS. 4 and 5 embodiments. Moreover, diode bridge 62 allows the series cap to be one half the value as the series cap in the embodiments of FIGS. 4 and 5. The FIG. 6 embodiment is the preferred embodiment because of the above-mentioned advantages, but there are many other well-know circuits that can be designed to drive the LEDs or other light sources and all of said well-known circuits are within the scope of this invention.

In the embodiment of FIG. 6, the AC mains are denoted 66. A one amp fuse is denoted 68 and a current-limiting resistor is denoted 70.

A three-way switch actuator 72 that provides a bright light in a first position, a medium light in a second position and a low light in a third position is denoted 72 as a whole.

In the first or "high light" position, current flows through capacitor 74 and conductors 74*a*, 74*b* to bypass capacitors 76 and 78. In the second, or medium light position, current flows through capacitors 74, 76, and conductors 76*a*, 74*b* to bypass capacitor 78. No current flows through conductor 74*a* because it is an open circuit when switch 72 is in said medium light position. In the third, or low light position, current flows through all three capacitors 74, 76, and 78 because conductors 74*a*, 76*a*, and 74*b* are open circuits.

In all embodiments, the LEDs, or any substitute light source, may be battery operated.

The floor of a room equipped with the novel night light is well-illuminated so that it is safe to walk on such floor at night. This greatly reduces the chances of falling, stubbing toes on furniture, and so on. Advantageously, the beams of light are fanned out as aforesaid so that a wide area is illuminated.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A night light, comprising:

a housing of predetermined configuration;

said housing having a top wall, a bottom wall, and a sidewall interconnecting said top and bottom walls;

said housing bottom wall disposed in overlying relation to a floor;

said housing having a low profile so that it may be positioned under a preselected article of furniture;

at least one light source associated with said housing;

said at least one light source being in electrical communication with a source of electrical power;

at least one aperture of predetermined configuration formed in said sidewall of said housing;

said at least one aperture configured to enable said at least one light source to illuminate at least a part of said floor;

whereby said night light may be positioned at any preselected location on a floor where illumination is desired.

2. The night light of claim 1, further comprising:

said at least one light source being positioned within said housing, radially inward of said at least one aperture.

3. The night light of claim 1, further comprising:

said at least one light source being positioned flush with said at least one aperture.

4. The night light of claim 1, further comprising:

said at least one light source being positioned externally of said housing, radially outward of said at least one aperture.

5. The night light of claim 1, further comprising:

said sidewall of said housing having a cylindrical configuration.

6. The night light of claim 5, further comprising:

said at least one aperture having a predetermined circumferential extent;

said at least one light source being positioned within said housing, radially inward of said at least one aperture;

whereby at least one generally fan-shaped area of said floor is illuminated.

7. The night light of claim 1, further comprising:

said at least one aperture being a plurality of apertures formed in said sidewall;

whereby a plurality of areas of said floor is illuminated by said at least one light source.

8. The night light of claim 7, further comprising:

said at least one light source being a plurality of light sources.

9. The nightlight of claim 8, further comprising:

each light source of said plurality of light sources being a light-emitting diode;

a first plurality of said light-emitting diodes and a second plurality of light-emitting diodes being electrically connected in parallel relation to one another;

said first plurality of said light-emitting diodes conducting electricity and emitting light during a positive half of an AC cycle; and said second plurality of said light-emitting diodes conducting electricity and emitting light during a negative half of an AC cycle.

10. The night light of claim 8, further comprising:

each light source of said plurality of light sources being a light-emitting diode;

each of said light-emitting diodes being electrically connected in series relation to one another;

a diode bridge disposed between a source of AC electrical power and said light-emitting diodes;

each of said light-emitting diodes conducting electricity and emitting light during a positive half of an AC cycle.

11. The night light of claim 8, further comprising:

each light source of said plurality of light sources being a light-emitting diode;

each of said light-emitting diodes being electrically connected in series relation to one another;

a diode bridge disposed between a source of AC electrical power and said light-emitting diodes;

each of said light-emitting diodes conducting electricity and emitting light during a negative half of an AC cycle.

12. The night light of claim 8, further comprising:

each light source of said plurality of light sources being associated with an aperture of said plurality of apertures.

13. The night light of claim 12, further comprising:

each light source of said plurality of light sources being disposed within said housing radially inward of an aperture with which each light source is associated.

14. The night light of claim 12, further comprising:

each light source of said plurality of light sources being disposed flush with its associated aperture.

15. The night light of claim 12, further comprising:

each light source pf said plurality of light sources being disposed externally of said housing radially outward of an aperture with which each light source is associated.

16. The night light of claim 1, further comprising:

said sidewall of said housing having a multifaceted configuration;

at least one aperture formed in at least one face of said multifaceted sidewall.

17. The night light of claim 1, further comprising:

said housing having a flat top wall and a flat bottom wall;

said flat bottom wall disposed in overlying relation to a floor.

18. The night light of claim 17, further comprising:

an elongate power cord adapted to provide electrical communication between said at least one light source and a remote electrical wall outlet so that said housing may be positioned in remote relation to said electrical wall outlet.

19. The night light of claim 17, further comprising:

said housing adapted to house a battery that is in electrical communication with said at least one light source so that said housing may be positioned at any preselected location in a room.

20. A night light, comprising:

a housing of predetermined configuration;

said housing having a top wall and a bottom wall that are disposed in parallel, vertically spaced apart relation to one another;

said housing bottom wall disposed in overlying relation to a floor;

said housing having a low profile so that it may be positioned under a preselected article of furniture;

a light source positioned between said top wall and said bottom wall, said light source being in electrical communication with a source of electrical power;

said light source being centered with respect to said top wall and bottom wall;

whereby an area of a floor surrounding said housing is illuminated.

21. A night light, comprising:

a housing of predetermined configuration;

said housing having a top wall, a bottom wall, and a sidewall interconnecting said top and bottom walls;

said housing bottom wall disposed in overlying relation to a floor;

said housing having a low profile so that it may be positioned under a preselected article of furniture;

at least one light source associated with said housing;

said at least one light source being in electrical communication with a source of electrical power;

at least one aperture of predetermined configuration formed in said sidewall of said housing;

said at least one aperture configured to enable said at least one light source to illuminate at least a part of said floor;

said at least one light source being a plurality of light sources;

said at least one aperture being a plurality of apertures formed in said sidewall;

each light source of said plurality of light sources being associated with an aperture of said plurality of apertures;

each light source of said plurality of light sources being disposed flush with its associated aperture;

whereby said night light may be positioned at any preselected location on a floor where illumination is desired;

whereby a plurality of areas of said floor is illuminated by said at least one light source.

* * * * *